US012157065B1

(12) United States Patent
Rotharmel et al.

(10) Patent No.: US 12,157,065 B1
(45) Date of Patent: Dec. 3, 2024

(54) ANTI-ROTATION TARGET ASSEMBLY FOR AN AMUSEMENT GAME DEVICE

(71) Applicant: STERN PINBALL, INC., Elk Grove Village, IL (US)

(72) Inventors: John Rotharmel, Elk Grove Village, IL (US); Robb Blakeman, Elk Grove Village, IL (US)

(73) Assignee: Stern Pinball, Inc., Elk Grove Village, IL (US)

( * ) Notice: Subject to any disclaimer, the term of this patent is extended or adjusted under 35 U.S.C. 154(b) by 660 days.

(21) Appl. No.: 17/347,098

(22) Filed: Jun. 14, 2021

Related U.S. Application Data

(60) Provisional application No. 63/039,170, filed on Jun. 15, 2020.

(51) Int. Cl.
*A63F 7/36* (2006.01)
*A63F 7/02* (2006.01)
*A63F 7/30* (2006.01)

(52) U.S. Cl.
CPC ..... *A63F 7/3065* (2013.01); *A63F 7/027* (2013.01)

(58) Field of Classification Search
CPC ..... A63B 7/025; A63B 7/027; A63B 7/3065
See application file for complete search history.

(56) References Cited

U.S. PATENT DOCUMENTS 4,354,681 A * 10/1982 Garbark ..... A63F 7/3065 273/127 R
4,805,906 A * 2/1989 Wiczer ..... A63F 7/027 312/282
4,848,748 A * 7/1989 Krutsch ..... A63F 7/027 273/121 E
4,861,037 A * 8/1989 Oursler ..... A63F 7/027 273/121 D
4,943,061 A * 7/1990 Grabel ..... A63F 7/3065 273/127 R
5,123,647 A * 6/1992 Lawlor ..... A63F 7/3065 273/127 R
5,226,653 A * 7/1993 Bil ..... A63F 7/3065 273/127 R
5,338,031 A 8/1994 Patla, Sr. et al.
5,356,142 A * 10/1994 Borg ..... A63F 7/027 273/121 A
5,358,242 A * 10/1994 Trudeau ..... A63F 7/027 273/121 A
5,358,244 A * 10/1994 Kaminkow ..... A63F 7/027 273/121 A (Continued)

FOREIGN PATENT DOCUMENTS

EP 0412500 A1 * 2/1991 ..... A63F 7/02

*Primary Examiner* — Raleigh W Chiu
(74) *Attorney, Agent, or Firm* — Greenberg Traurig, LLP

(57) ABSTRACT

A target assembly for an amusement device includes a switch stack comprising a target leaf spring, a contact leaf spring, and a spacer electrically isolating the target leaf spring from the contact leaf spring. An anti-rotation shell is mounted to the switch stack and at least partially surrounds one end of the target leaf spring and the contact leaf spring. The anti-rotation shell is sized and configured to substantially prevent relative movement between the target leaf spring and the contact leaf spring. In some examples, a switch mount bracket includes slot to receive side walls of the anti-rotation shell.

14 Claims, 5 Drawing Sheets

(56) References Cited

U.S. PATENT DOCUMENTS

| | | | | |
|---|---|---|---|---|
| 5,580,052 | A * | 12/1996 | Popadiuk | A63F 7/027 273/127 R |
| 5,716,049 | A | 2/1998 | Pundzus et al. | |
| 6,158,737 | A | 12/2000 | Cornell et al. | |
| 2007/0026918 | A1 | 2/2007 | Sheats | |
| 2013/0112835 | A1* | 5/2013 | Buley | B60R 1/078 248/224.8 |

* cited by examiner

ANTI-ROTATION TARGET ASSEMBLY FOR AN AMUSEMENT GAME DEVICE

CROSS REFERENCE TO RELATED APPLICATION

This application is a non-provisional application claiming priority from U.S. Provisional Application Ser. No. 63/039,170 filed Jun. 15, 2020, and incorporated herein by reference in its entirety.

FIELD OF THE DISCLOSURE

The present disclosure relates generally to amusement games and more particularly to an anti-rotation target assembly for an amusement game device.

BACKGROUND OF RELATED ART

Amusement game devices, such as pinball machines, redemption games, etc. of the commercial, e.g., revenue generating, and non-commercial, e.g., home entertainment, type are well known in the art. By way of example, U.S. Pat. Nos. 5,338,031, 6,158,737, and U.S. Published Application No. 2007/0026918 illustrate and describe amusement game devices of the type having a cabinet which houses a playfield.

Various targets and bumpers for use on the playfield of such amusement game devices are also generally known in the art. By way of example, a traditional pinball standup target includes a vertically positioned spot target coupled to a suitable switch located above and below the playfield. The target assembly is mounted to the playfield such that when the target is contacted by a ball the target actuates the leaf switch to register a ball contact.

For instance, U.S. Pat. No. 5,716,049 describes a target and associated impact sensing mechanism including a target head above the pinball playing surface which is movable from a first position above the playing surface to a second position above the playing surface upon receiving a sufficient impact force from the pinball. A switch actuator depends from the head and extends below the playing surface in the interior of the pinball machine. A switch has an open state and a closed state with the switch actuator changing the switch from its open state to its closed state as an incident of the movement of the target head from the first position to the second position.

Traditional vertical targets are oftentimes repeatedly impacted by a pinball at various angles and velocities during normal gameplay. As such, over time, the target may become misaligned or move from their intended playfield location.

While the various targets, generally work for their intended purpose, there is an identifiable desire for improvements to target construction and resultant, consistent gameplay, with reduced playfield maintenance. For instance, the present invention provides for a pinball target mechanism that provides for a reduced rotation as a result of normal gameplay.

DETAILED DESCRIPTION

The following description of example methods and apparatus is not intended to limit the scope of the description to the precise form or forms detailed herein. Instead the following description is intended to be illustrative so that others may follow its teachings.

Pinball machine playfields often use stand-up targets, which comprise stacks of leaf switch blades and spacers. Over time, repeated hits from a pinball can cause the target components to become misaligned or jammed against other playfield objects and interfere with proper functioning of the switch. Current solutions rely on keeping the assembly aligned through external means such as brackets or plastic blocks, or the requirement for constant game disassembly and realignment by an operator.

Figure 1:
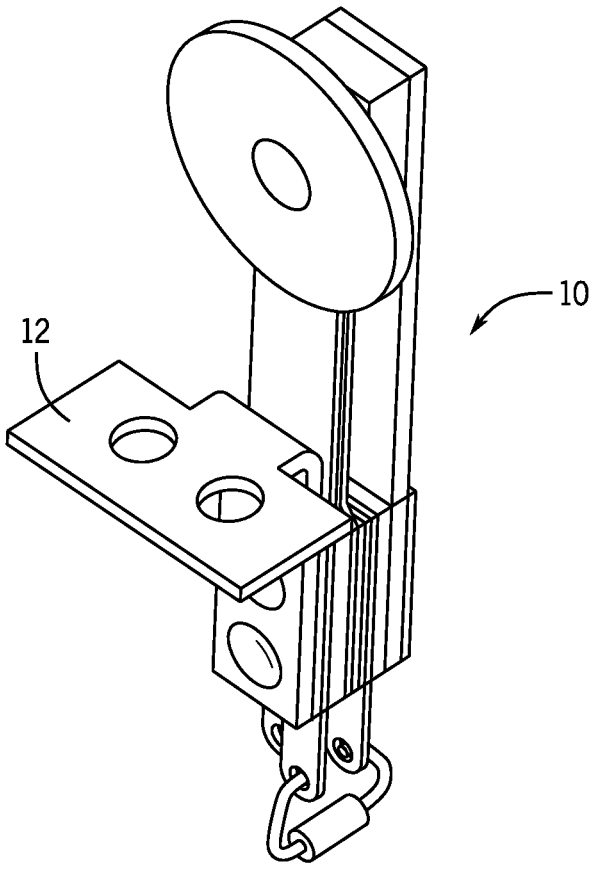
FIG. 1 PRIOR ART
FIG. 1 is a perspective view of a prior art leaf spring type front mount face target assembly.
Figure 2:
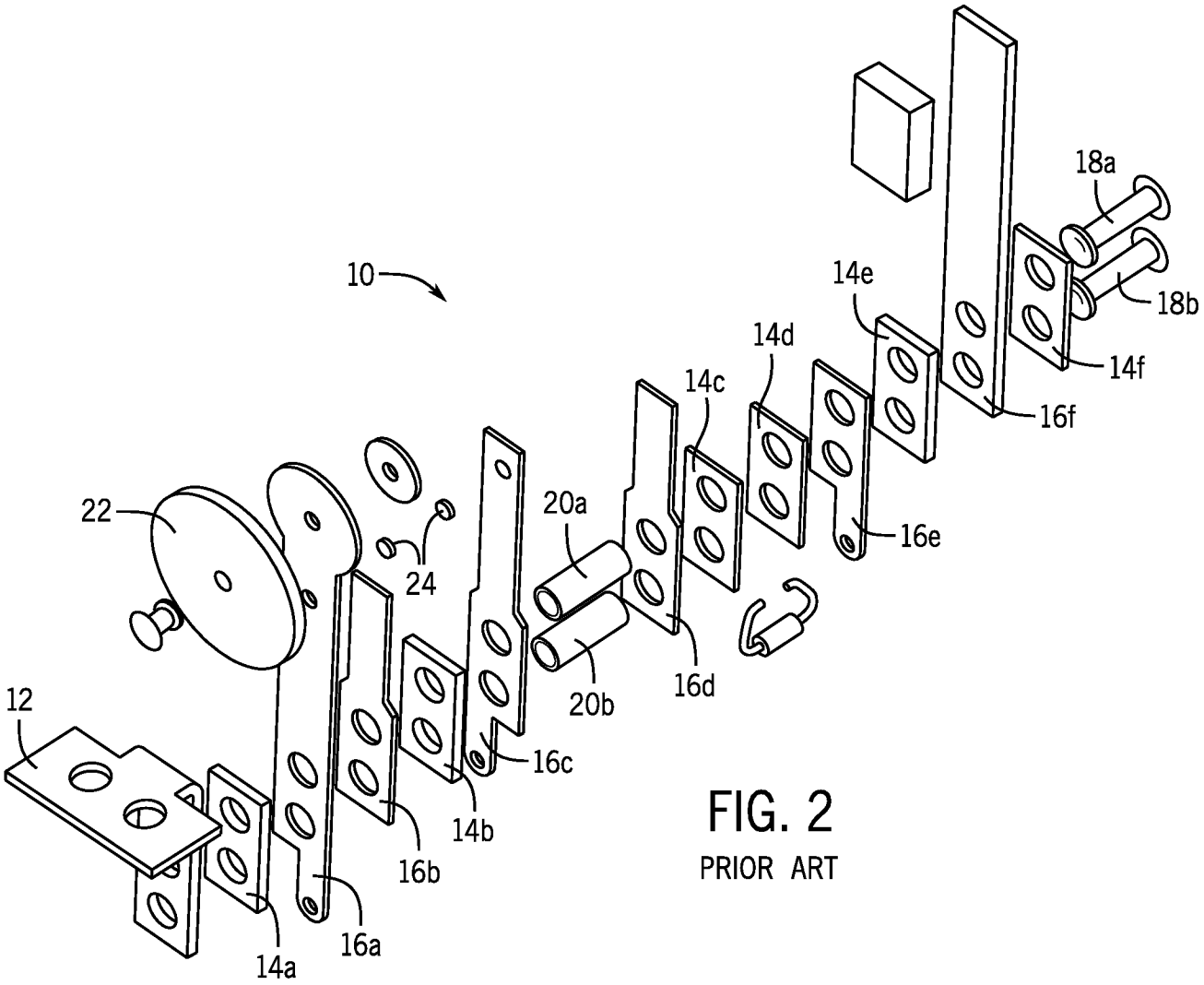
FIG. 2 PRIOR ART
FIG. 2 is an exploded view of the prior art face target assembly of FIG. 1.

For instance, FIGS. 1 and 2 illustrate a prior art leaf spring type front mount face target assembly 10. The illustrated target assembly 10 includes a mounting bracket 12 configured for mounting to an underside of a playfield. Coupled to the mounting bracket 12 are a plurality of alternating spacers 14*a*-14*f* and leaf switch blades 16*a*-16*f*. The spacers 14*a*-14*f* are electrically non-conductive while the leaf switch blades 16*a*-16*f* are electrically conductive. A pair of fasteners 18*a*, 18*b*, extend through apertures defined in each of the spacers 14*a*-14*f* and the leaf switch blades 16*a*-16*f*. The fasteners 18*a* and 18*b* include insulating sleeves 20*a* and 20*b*. The leaf switch blade 16*a* includes a mountable target 22 that, when struck by a moving pinball, will deflect and cause contact pads 24 mounted respectively on the leaf switch blades 16*a* and 16*c* to contact, creating a completed electrical circuit and registering a pinball impact with the assembly 10.

As previously noted, while the prior art target assembly 10 may be suitable for its intended purposes, repetitive impact with the target assembly 10 by a pinball, especially any pinball that strikes the target assembly 10 off-center, may cause movement of the various parts of the target assembly 10 that may affect the alignment position of the various components, including the leaf switch blades 16*a*-16*f*, the contact pads 24, etc. thereby causing the target assembly 10 to fail to reliably register a pinball impact.

Figure 5A:
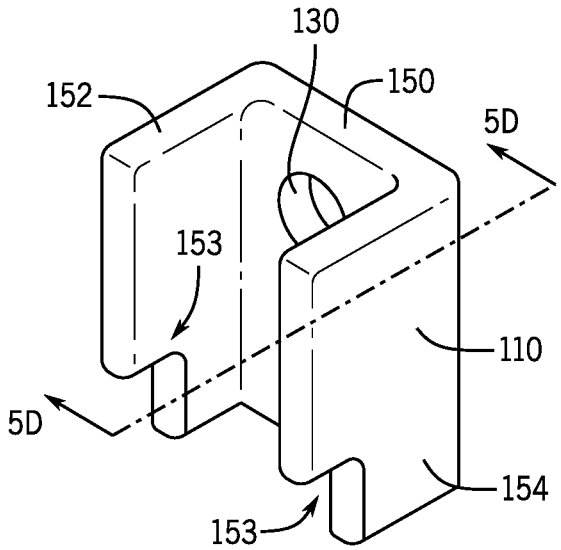
FIG. 5A is a perspective view of the anti-rotation housing for use with the anti-rotation target assembly of FIG. 3 and FIG. 4.
Figure 5B:
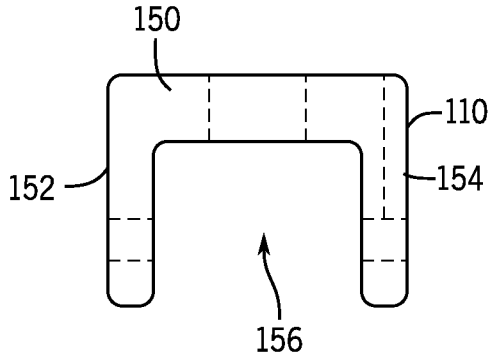
FIG. 5B is a bottom plan view of the housing of FIG. 5A.
Figure 5C:
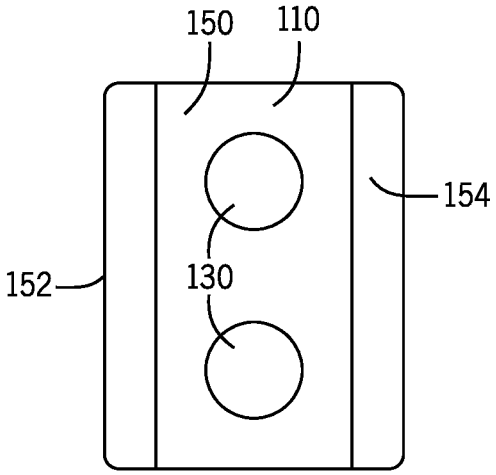
FIG. 5C is a front elevational view of the housing of FIG. 5A.
Figure 5D:
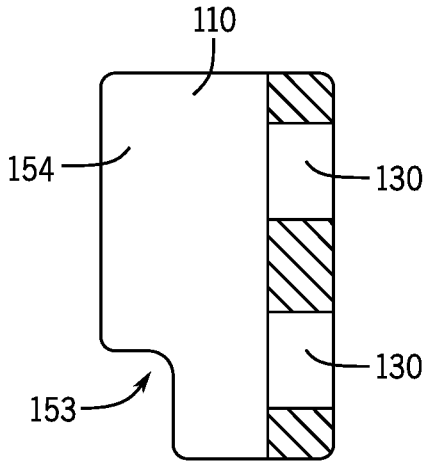
FIG. 5D is a cross-sectional side view of the housing of FIG. 5A, taken along line D-D.
Figure 6:
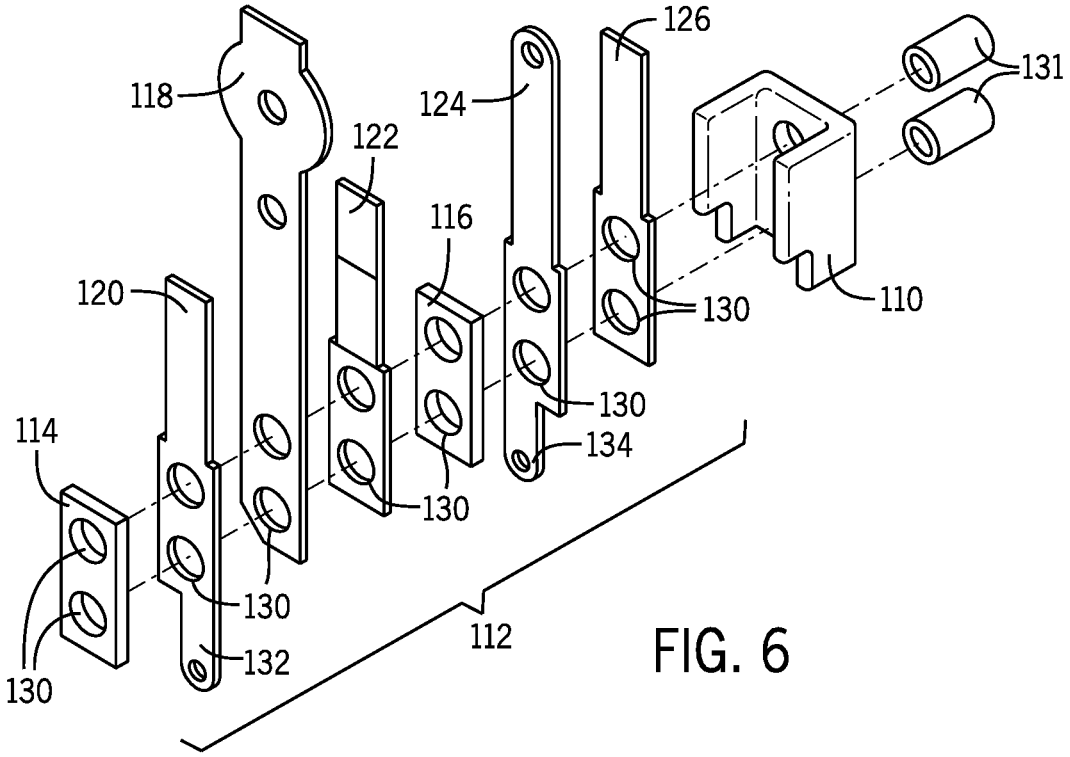
FIG. 6 is an exploded view of the anti-rotation target assembly of FIG. 3.
Figure 7A:
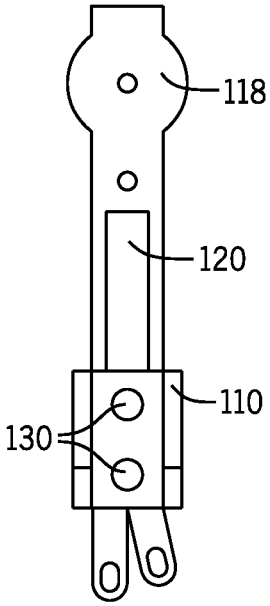
FIG. 7A is a front elevational view of a portion of the anti-rotation assembly of FIG. 3.
Figure 7B:
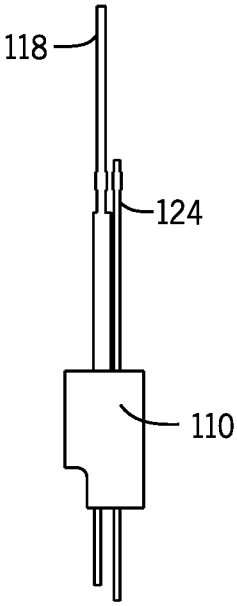
FIG. 7B is a side elevational view of the assembly portion of FIG. 7A.
Figure 7C:
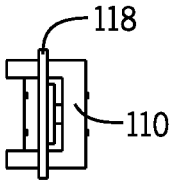
FIG. 7C is a top plan view of the assembly portion of FIG. 7A.

Referring now to FIG. 3 through FIG. 7C, an example target assembly 100 constructed in accordance with the teachings of the present disclosure is illustrated. The example target assembly 100 includes a stand-up target with an anti-rotation shell 110 mounted directly to a switch stack 112. More specifically, as best seen in FIG. 6, the example switch stack 112 comprises a first spacer 114 and a second spacer 116 with a target leaf spring 118 having a first stiffening leaf spring 120 and a second stiffening leaf spring 122 located between the first spacer 114 and the second spacer 116. A target 119 may be coupled to the target leaf spring 118 (See FIGS. 3 and 4). Located on an opposite side of the second spacer 116 is a contact leaf spring 124 with an accompanying, stiffening leaf spring 126. As illustrated, each of the leaf springs and spacers within the switch stack 112 includes at least one defined aperture 130 located in an end of its respective component for accepting a corresponding fastener 131.

In this example, each of the first spacer 114 and the second spacer 116 is electrically non-conductive, while each of the first stiffening leaf spring 120, the target leaf spring 118, the second stiffening leaf spring 122, the contact leaf spring 124, and the stiffening leaf spring 126 is electrically conductive. As will be appreciated, the first stiffening leaf spring 120, the target leaf spring 118, and the second stiffening leaf spring 122 are electrically coupled to a first portion of a circuit of the amusement device through a first electrical connector 132 while the contact leaf spring 124 and the stiffening leaf spring 126 are electrically coupled to a second portion of the circuit of the amusement device through a second electrical connector 134. The electrical circuit is "open" until a force, such as a pinball strike to the target leaf spring 118, deflects the target leaf spring 118 to contact the contact leaf spring 124. As noted above, repeated impact and/or deflection of the target leaf spring 118 may shift, twist, and/or otherwise misalign the components of the switch stack 112.

In the illustrated example, in order to better retain all of the components of the switch stack 112 in proper alignment, the switch stack 112 is housed within the anti-rotation shell 110. As best shown in FIGS. 5A to 5D, the example anti-rotation shell 110 is generally U-shaped, having a back wall 150 and a side wall 152 extending generally perpendicular from a first edge of the back wall 150 and a side wall 154 extending generally perpendicular from a second edge of the back wall 150. The back wall 150 of the anti-rotation shell 110 also comprises at least one corresponding aperture 130 for receiving the corresponding fastener 131. Together, the back wall 150, the side wall 152 and the side wall 154 define a space 156 therein for receiving the components of the switch stack 112. As will be appreciated, the space 156 is sized within a redefined tolerance to abut against the components of the switch stack 112 and substantially prevent any relative movement, shifting and/or other moment between the components. In this example, the anti-rotation shell 110, and in particular the side wall 152 and the side wall 154, is electrically non-conductive (e.g., plastic) to prevent any short circuit between the components of the switch stack 112, but in various examples, the anti-rotation shell 110 may be electrically conductive (e.g., metal) with a non-conductive spacer, coating, or other similar component (not shown) located between the switch stack 112 and the anti-rotation shell 110 to prevent any electrical short circuits within the switch stack 112.

Figure 3:
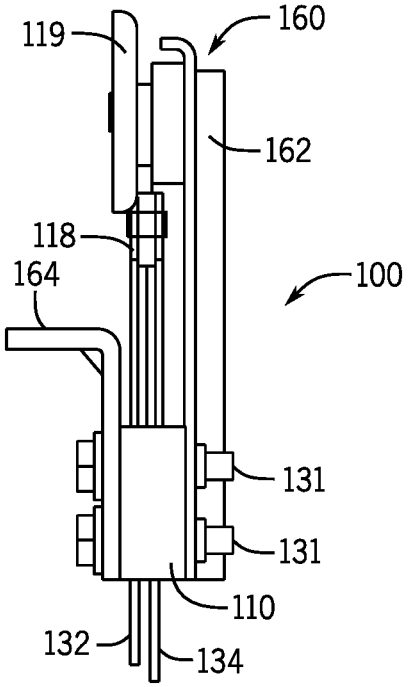
FIG. 3 is a perspective view of an anti-rotation target assembly for an amusement game device constructed in accordance with the teachings of the present invention.
Figure 4:
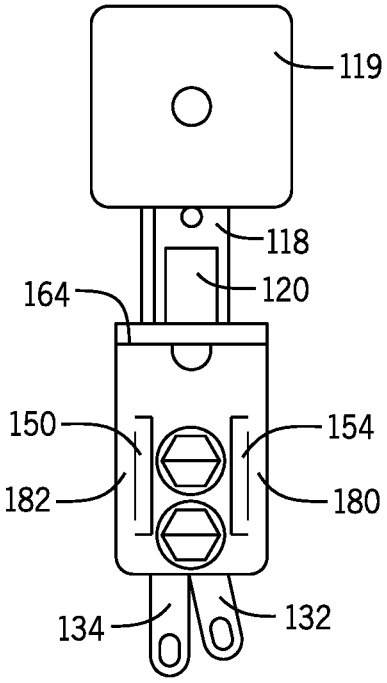
FIG. 4 is a front elevational view of the anti-rotation target assembly of FIG. 3.

As further illustrated in FIG. 3, the target assembly 100 may optionally also include additional target assembly components, such as a deflection stop 160. The example deflection stop 160 includes an upstanding arm 162 extending parallel to the target leaf spring 118. As will be understood, the deflection stop 160 may prevent any deformable deflection of the target leaf spring 118 by an impact on the target 119. It will further be appreciated that the entire target assembly 100 may be mounted to playfield of the amusement device via a switch mount bracket 164 or other suitable mounting means. In still other examples, the components of the deflection stop 160 and or the switch mount bracket 164 may also be housing at least partially within the anti-rotation shell 110.

The anti-rotation shell 110 reduces and/or eliminates the need for external components to aid in keeping the target 119 aligned and allows for more infrequent playfield adjustment by an operator. In utilizing the current anti-rotation shell 110, the switch mount bracket 164 comprises a first slot 180 and a second slot 182 (see FIG. 4) to match and receive the side wall 152 and the side wall 154 of the anti-rotation shell 110 and further lock the anti-rotation shell 110 in place around the switch stack 112. As shown in FIG. 5A and FIG. 5D, the side wall 152 and the side wall 154 may each comprise a notch 153 to size each of the side walls to fit into the first slot 180 and the second slot 182. As will be appreciated by one of ordinary skill in the art, the disclosed anti-rotation shell 110 can be made from any combination of materials that does not short-circuit the leaf switch components and yet provide sufficient rigidity for keeping alignment of the target, such as for instance, plastic.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. A target assembly for an amusement device comprising:

a switch stack comprising a target leaf spring, a contact leaf spring, and a spacer electrically isolating the target leaf spring from the contact leaf spring; and an anti-rotation shell mounted to the switch stack and at least partially surrounding one end of the target leaf spring and the contact leaf spring, the anti-rotation shell sized and configured to substantially prevent relative movement between the target leaf spring and the contact leaf spring.

2. The target assembly as defined in claim 1, further comprising a fastener mounting the anti-rotation shell to the switch stack and extending through apertures defined in the target leaf spring, the contact leaf spring, the spacer, and the anti-rotation shell.

3. The target assembly as defined in claim 2, further comprising a switch mount bracket coupled to the switch stack and the anti-rotation shell for mounting the target assembly to the amusement device.

4. The target assembly as defined in claim 3, wherein the anti-rotation shell comprises a back wall, a first side wall extending generally perpendicular from a first edge of the back wall, and a second side wall extending generally perpendicular from a second edge of the back wall.

5. The target assembly as defined in claim 4, wherein the anti-rotation shell comprises an electrically non-conductive material.

6. The target assembly as defined in claim 4, wherein the switch mount bracket comprises a first slot to receive the first side wall of the anti-rotation shell and a second slot to receive the second side wall of the anti-rotation shell.

7. The target assembly as defined in claim 6, wherein the first side wall comprises a notch to size the first side wall to fit into the first slot.

8. The target assembly as defined in claim 7, wherein the second side wall comprises a notch to size the second side wall to fit into the second slot.

9. The target assembly as defined in claim 3, further comprising a deflection stop coupled to the anti-rotation shell and extending parallel to the target leaf spring and the contact leaf spring.

10. The target assembly as defined in claim 9, wherein the anti-rotation shell is disposed between the deflection stop and the contact leaf spring.

11. An anti-rotation shell for housing a switch stack of a leaf spring target assembly, the anti-rotation shell comprising:

a back wall;

a deflection stop coupled to the back wall;

a first side wall extending generally perpendicular from a first edge of the back wall;

a second side wall extending generally perpendicular from a second edge of the back wall; and a switch mount bracket located opposite the back wall, wherein the switch stack is to be located between the switch mount bracket and the back wall, the switch mount bracket comprising a first slot to receive the first side wall of the anti-rotation shell and a second slot to receive the second side wall of the anti-rotation shell, wherein together, the back wall, the first side wall, and the second side wall define a space for receiving the switch stack at least partially therein.

12. The anti-rotation shell as defined in claim 11, wherein the first side wall comprises a notch to size the first side wall to fit into the first slot.

13. The anti-rotation shell as defined in claim 11, wherein the second side wall comprises a notch to size the second side wall to fit into the second slot.

14. The anti-rotation shell as defined in claim 11, wherein the first side wall and the second side wall comprise an electrically non-conductive material.

* * * * *